US007234490B2

(12) United States Patent
Dorr

(10) Patent No.: US 7,234,490 B2
(45) Date of Patent: Jun. 26, 2007

(54) HYDRAULIC ACCUMULATOR COMPRISING A POSITION INDICATOR

(75) Inventor: Walter Dorr, Volklingen (DE)

(73) Assignee: Hydac Technology GmbH., Sulzbach/Saar (DE)

( * ) Notice: Subject to any disclaimer, the term of this patent is extended or adjusted under 35 U.S.C. 154(b) by 0 days.

(21) Appl. No.: 10/548,469

(22) PCT Filed: Jan. 22, 2004

(86) PCT No.: PCT/EP2004/000471

§ 371 (c)(1),
(2), (4) Date: Sep. 12, 2005

(87) PCT Pub. No.: WO2004/081389

PCT Pub. Date: Sep. 23, 2004

(65) Prior Publication Data

US 2006/0213365 A1 Sep. 28, 2006

(30) Foreign Application Priority Data

Mar. 11, 2003 (DE) ..... 103 10 427

(51) Int. Cl.
*F16L 55/04* (2006.01)

(52) U.S. Cl. ..... 138/31; 138/30; 138/26; 73/744

(58) Field of Classification Search ..... 138/31, 138/30, 26; 200/82 E; 73/745, 744, 746
See application file for complete search history.

(56) References Cited

U.S. PATENT DOCUMENTS

| | | | | |
|---|---|---|---|---|
| 4,181,835 | A * | 1/1980 | Stadler et al. | 200/82 E |
| 4,608,870 | A * | 9/1986 | Huber et al. | 73/708 |
| 4,754,648 | A | 7/1988 | Byrd et al. | 73/744 |
| 4,755,636 | A * | 7/1988 | Akio | 200/82 E |

FOREIGN PATENT DOCUMENTS

| | | |
|---|---|---|
| DE | 3411367 A1 | 10/1985 |
| DE | 3910691 A1 | 10/1990 |
| DE | 101 43 675 A1 | 2/2003 |

* cited by examiner

*Primary Examiner*—Patrick F. Brinson
(74) *Attorney, Agent, or Firm*—Roylance, Abrams, Berdo & Goodman, L.L.P.

(57) ABSTRACT

A hydraulic accumulator includes an accumulator housing (1) formed of a non-magnetizable material and defining an axial direction of the housing. A separating element (9) can be axially displaced in the accumulator housing (1) and separates two working chambers (5, 7) from each other in the accumulator housing (1). A field-generating magnetic configuration (29) is arranged on the separating element. A series of magnetic field sensors (35) are arranged on the outer side of the accumulator housing (1), extend along the path of the axial movement of the separating element (9) and react to the field of the magnetic configuration (29) on the separating element (9) to characterize its position along the series of magnetic field sensors (35).

8 Claims, 2 Drawing Sheets

HYDRAULIC ACCUMULATOR COMPRISING A POSITION INDICATOR

FIELD OF THE INVENTION

The present invention relates to hydraulic accumulators, such as those provided with hydraulic assemblies, to receive specific volumes of a fluid under pressure (such as a hydraulic medium) and to return these volumes to an assembly as required. Hydropneumatic (gas-charged) accumulators are currently used in most hydraulic assemblies. The movable separating element inside the accumulator housing separates a fluid space as one working chamber from a gas supply space as the other working chamber. Nitrogen gas is normally used as working gas. The gas-tight separating element, such as a piston if a piston-type accumulator is involved, to a great extent permits separation of the gas supply space from the fluid space.

BACKGROUND OF THE INVENTION

The fluid component is connected to the hydraulic circuit of the assembly, so that the accumulator receives fluid as the pressure rises, with the gas being compressed. As pressure drops, the compressed gas expands and forces the pressurized fluid stored back into the hydraulic circuit. The changes in the volumes of gas supply space and fluid space result in corresponding axial movement of the separating element inside the accumulator housing.

A prerequisite for the trouble-free operation of hydraulic accumulators desired is setting the gas precharging pressure prevailing in the gas supply space be at a value adapted to the pressure level of the fluid component, so that the separating element, that is, the piston in the case of piston-type accumulators, is in a suitable position inside the cylinder housing. Such a position of the separating element must permit it to execute the operating movements required in the axial direction between the end positions in the accumulator housing.

SUMMARY OF THE INVENTION

An object of the present invention is to provide a hydraulic accumulator which permits determination by simple means, during operation, of the extent of the volumes of the working chambers, and accordingly, determination of the position of the separating element.

This object is attained by a hydraulic accumulator having an accumulator housing of non-magnetizable material defining the axial direction of the housing, a separating element movable in the axial direction in the accumulator housing and separating two working chambers from each other in the accumulator housing, a magnet configuration generating a field and mounted on the separating element, and a row of magnetic field sensors mounted on the exterior of the accumulator housing and extending along the path of axial movement of the separating element. The magnetic field sensors respond to the field of the configuration of magnets on the separating element to mark the position of such field along the row of magnetic field sensors.

The hydraulic accumulator of the present invention accordingly allows contact-free indication of the position of the separating element transmitted to the exterior through the wall of the accumulator housing. Simple and reliable monitoring of the operational status of the hydraulic accumulator during operation is thereby made possible.

If the hydraulic accumulator is a piston-type accumulator, a cylindrical tube is provided as the accumulator housing. The piston forming the separating element may be displaced axially in the tube over a piston stroke path. The row of magnetic field sensors on the exterior of the cylindrical tube is mounted more or less over the entire stroke path of the piston.

In one especially advantageous embodiment of the present invention, the piston is in the form of a non-magnetizable material, and the piston has a plurality of permanent magnets distributed over the circumferences of the piston. These magnets are in alignment with each other in relation to the axial direction.

In one especially simple design, the magnetic field sensors on the exterior of the cylindrical tube are a row of movable, preferably bar-like, permanent magnets. Those magnets are oriented toward the field generated by the piston magnets, and may be deflected by this field to an indicator position. The bar-like permanent magnets then function as visually detectable indication markings, the deflection of which provides a direct optical indication of the respective piston position.

Preferably, the rod-like permanent magnets may be deflected against a slight resetting force. If the magnetic field of the piston moves out of the sensor range during displacement of the piston, the sensor magnets automatically return to their initial position. For this contingency, the bar-like permanent magnets can be mounted to be freely pivotable for their deflection movement about pivot axes positioned outside the centers of gravity of the bar-like permanent magnets so that the force of gravity in effect exerts a resetting moment on the bar-like permanent sensor magnets.

Special steel or a non-ferritic metal alloy such as an aluminum alloy or, if pressure of limited level is involved, optionally a plastic, may be provided as material for the non-magnetizable accumulator housing.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
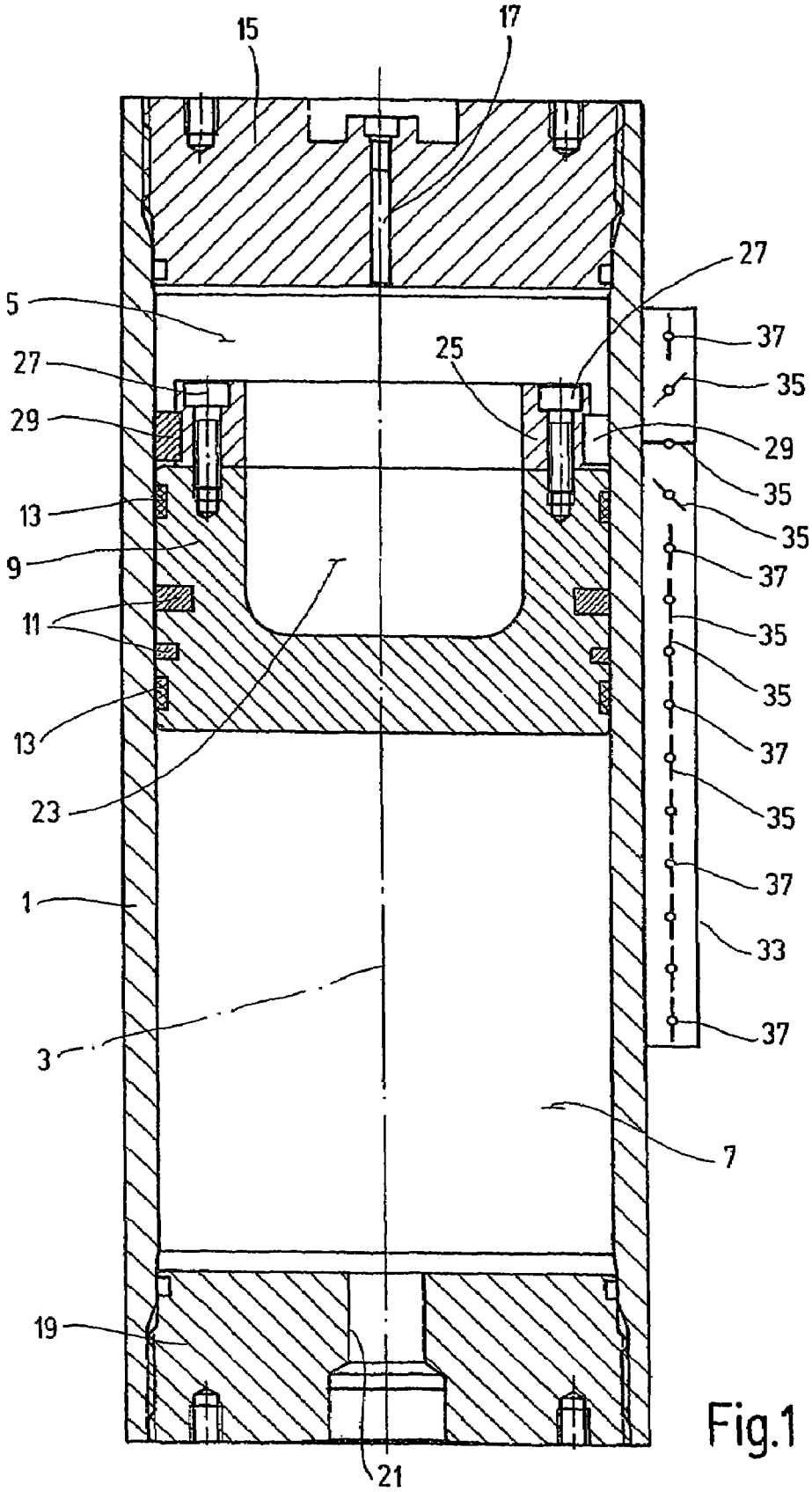
FIG. 1 is a side elevational view in section of a hydraulic accumulator according to an embodiment of the present invention in the form of a piston-type accumulator.

The exemplary embodiment shown in the drawings of the hydraulic accumulator according to the present invention is a piston-type accumulator. An accumulator housing is in the form of a cylindrical tube 1 defining a longitudinal axis 3. In the cylindrical tube 1, a piston 9 forming the separating element may be moved in the axial direction between a gas supply space 5 and a fluid space 7. By a method customary for piston-type accumulators, the piston 9 has, in annular grooves made in its circumferential surface, piston seals 11 and piston guides 13 which permit low-friction and gas-tight guiding of the piston 9 along the longitudinal axis 3.

The cylindrical tube 1 is closed on the end closing the gas supply space 5 by a screwed-in cylinder cover 15. A gas channel 17, to which a gas valve or a charging fitting (both not shown) may be connected, extends through the cylinder cover 15.

The cylindrical tube 1 is similarly closed on the end associated with the fluid space 7 by a screwed-in cover 19 having a central fluid passage 21.

Figure 2:
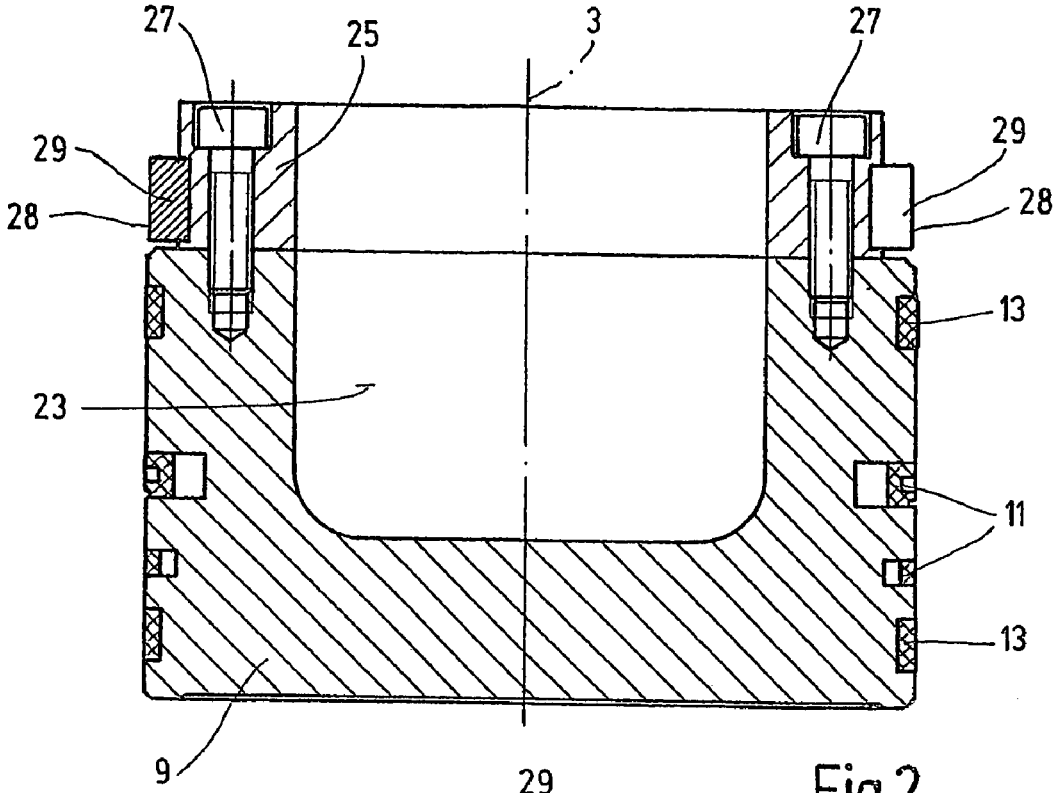
FIG. 2 is a side elevational view in section, on a scale somewhat larger than that of FIG. 1, of the piston only of FIG. 1, taken along line III-III in FIG. 3.
Figure 3:
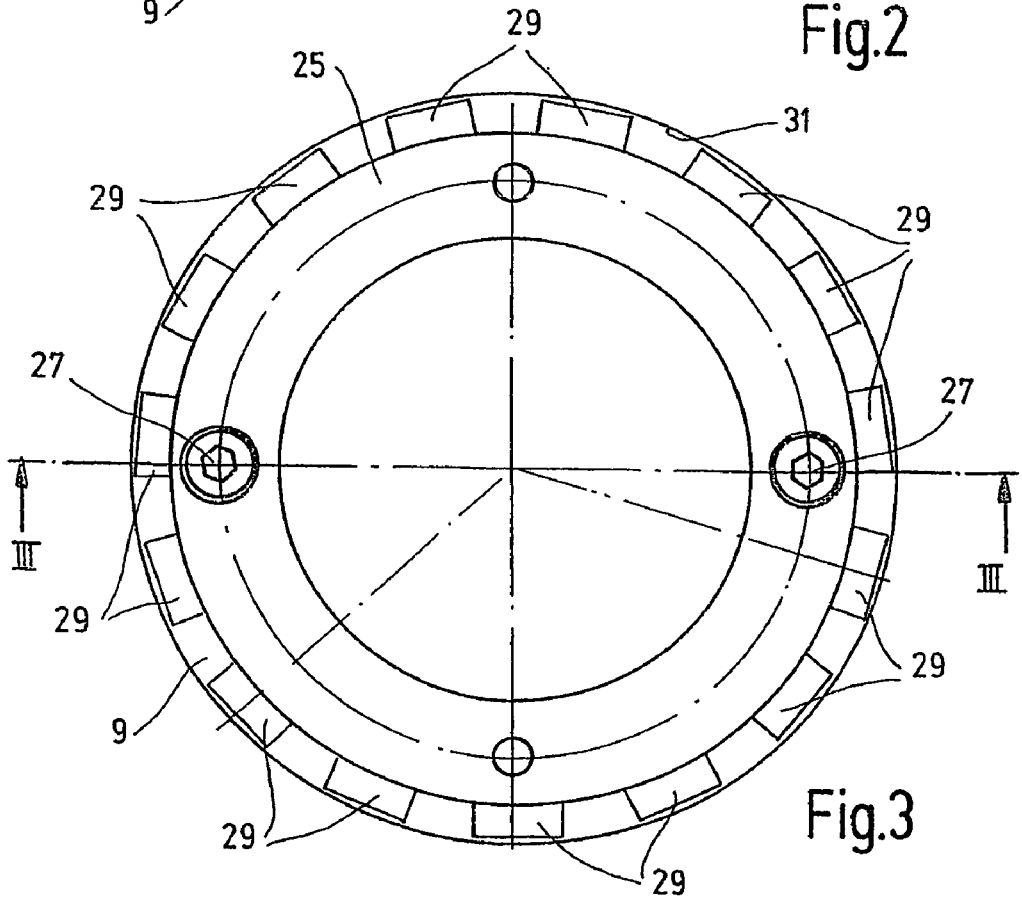
FIG. 3 is a top view of the piston of FIG. 2.

The piston 9 has a depression in the form of an interior trough 23 concentric with the axis 3 and open on the end of the piston facing the gas supply space 5 so that the volume of the gas supply space 5 is increased. An annular element 25, concentric with the axis 3, is joined by connecting bolts 27 to the piston 9 on the side of the piston having the open end of the trough 23. This annular element 25, the interior annular opening of which is in alignment with the opening edge of the trough 23 of the piston 9, is made of a non-magnetizable material, preferably the same material as that of the piston 9. The annular element 25 functions as supporting ring for permanent magnets 29 which are embedded in the circumferential surface of the annular element 25 concentric with the cylindrical tube 1 so that their radially exterior polar end surfaces 28 (FIG. 2) are spaced a short radial distance from the circumference of the piston 9 and accordingly from the interior wall of the cylindrical tube 1. In FIG. 3, the jacket surface of the piston 9 is designated as 31.

In FIG. 3, the exemplary embodiment has fifteen permanent magnets mounted around the circumference of the piston 9 at regular angular distances from each other. The permanent magnets 29 are mounted with the same polarity orientation so that the radially exterior polar end surfaces 28 form like magnetic poles.

In FIG. 1, during operation the piston 9 may be moved along a piston stroke path between an upper end position in which the annular element 25 is adjacent to the upper cylinder cover 15 and a lower end position in which the opposite side of the piston 9 approaches the lower cover 19. In moving between these end positions, the permanent magnets mounted on the annular element 25 of the piston 9 move over the length of a sensor strip 33 extending along the exterior of the cylindrical tube 1. Mounted on the strip is a row of permanent magnets. In the example illustrated, these permanent magnets are in the form of small bar magnets 35 (only a few of which are indicated in the figure). The row of bar magnets 35 extend more or less over the entire length of the sensor strip 33. The bar magnets 35 are mounted pivotably in pivot bearings 37 (only some of which are indicated in the figure). The pivot axes extend perpendicularly to the longitudinal axis 3 and in parallel with the tangents on the adjacent circumference of the cylindrical tube 1. With the permanent magnets 35 mounted in this manner, the magnetic field generated by the permanent magnets 29 on the annular element 25 of the piston 9 may cause these magnets 35 to be deflected along the longitudinal section of the sensor strip 33 on which the permanent magnets 29 are mounted. In FIG. 1, this deflection is illustrated for the piston position indicated, in which the piston is situated a small distance from the upper cylinder cover 15. As shown in FIG. 1, with the piston in this position, the third bar magnet 35 (counting from the top) is deflected to the horizontal position, while the adjacent second bar magnet 35 and fourth bar magnet 35 are partly deflected.

This deflection of the bar magnets 35 permits determination of the respective position of the piston 9 inside the cylindrical tube 1 by visual comparison with the non-deflected other magnets 35 of the sensor strip 33.

The bar magnets 35 may be provided with signal coloring in order to make the display eye-catching.

The bar magnets 35 may be mounted on the sensor strip 33 so that the deflection of bar magnets 35 by the magnetic field on the piston 9 is opposed by a slight resetting or biasing force. In this manner, the bar magnets 35 serving as indicator element during excursion of the magnetic field, that is, during stroke movement of the piston 9, automatically return to an initial or non-indicator position. The resetting force may be applied in any suitable manner, such as simply by positioning the pivot axes 37 of the bar magnets 35 outside their center of gravity so that the bar magnets 35 are reset automatically when the magnetic field does not exert its effect. To generate a resetting force for the bar magnets 35 so that they extend in parallel with the longitudinal axis 3 when the deflecting magnetic field is absent, the sensor strip 33 itself could be configured as a device generating a weak magnetic field. For example, the sensor strip itself could be in the form of a weak bar magnet.

As has already been stated, in the present invention a non-magnetizable material is provided for the cylindrical tube 1, the piston 9, and the annular element 25 of the piston. For example, a non-magnetizable steel (special steel), a non-ferritic metal alloy, aluminum alloy, or even a plastic material may be provided for the cylindrical tube 1, depending on the pressure level for which the accumulator is provided.

While one embodiment has been chosen to illustrate the invention, it will be understood by those skilled in the art that various changes and modifications can be made therein without departing from the scope of the invention as defined in the appended claims.

What is claimed is:

1. A hydraulic accumulator, comprising:

a cylindrical housing tube of non-magnetizable material defining a longitudinal axis and having first and second working chambers;

a separating piston of a non-magnetizable material mounted in said housing tube for movement axially along said longitudinal axis over a piston stroke path and separating said working chambers from one another;

an annular carrier of a non-magnetizable material fixedly mounted on one end of said piston and having a diameter smaller than an interior diameter of said housing tube, said carrier having a circumferential surface concentric with said housing tube;

a plurality of permanent piston magnets mounted on and distributed about said circumferential surface, axially aligned with one another relative to said longitudinal axis and arranged with polar axes thereof extending in radial directions relative to said longitudinal axis; and a row of magnetic field sensors mounted on an exterior of said housing tube substantially along all of said piston stroke path, said magnetic field sensors being responsive to said piston magnets to indicate positions of said piston magnets along said row.

2. A hydraulic accumulator according to claim 1 wherein said magnet field sensors are permanent sensor magnets with orientations deflectable by magnetic fields of said piston magnets into indicator positions.

3. A hydraulic accumulator according to claim 2 wherein said sensor magnets are bar-shaped.

4. A hydraulic accumulator according to claim 3 wherein said sensor magnets are pivotable about respective pivot axes substantially perpendicular to said longitudinal axis and substantially parallel to tangents on adjacent circumferential areas of said housing tube.

5. A hydraulic accumulator according to claim 4 wherein each of said pivot axes is spaced from a center of gravity of a respective one of said sensor magnets.

6. A hydraulic accumulator according to claim 1 wherein said piston magnets have radially exterior polar end surfaces with same polarities, and are positioned small distances from an interior surface of said housing tube.

7. A hydraulic accumulator according to claim 1 wherein said non-magnetizable materials of said housing tube is selected from the group consisting of steel, aluminum alloy and plastic.

8. A hydraulic accumulator according to claim 2 wherein said sensor magnets are biased toward non-deflected positions.

* * * * *